United States Patent [19]

Cole et al.

[11] Patent Number: 5,050,706

[45] Date of Patent: Sep. 24, 1991

[54] CEILING LADDER

[75] Inventors: Paul E. Cole, Burghill; Barry L. Guy, Poland, both of Ohio; Jay S. Wasser, Greenville, Pa.

[73] Assignee: R. D. Werner Co., Inc., Greenville, Pa.

[21] Appl. No.: 565,813

[22] Filed: Aug. 10, 1990

[51] Int. Cl.[5] ..... E04F 11/06

[52] U.S. Cl. ..... 182/78; 182/163

[58] Field of Search ..... 182/77, 78, 79, 80, 182/81, 24, 163

[56] References Cited

U.S. PATENT DOCUMENTS 437,936 10/1890 O'Brien ..... 182/24

1,811,708 6/1931 Bessler ..... 182/78

FOREIGN PATENT DOCUMENTS 366342 2/1932 United Kingdom ..... 182/78

*Primary Examiner*—Reinaldo P. Machado

*Attorney, Agent, or Firm*—Ansel M. Schwartz

[57] ABSTRACT

A foldable ladder having a plurality of sections which align during use to form a continuous ladder and which are foldable upon themselves for storage in a ceiling frame. The ladder includes hinges for connecting the sections. Each hinge has a first load bearing surface and second load bearing surface which contact each other for support a load when the ladder is extended. The ladder also includes an improved counter balance assembly which connects the ladder to the ceiling frame; and a continuous hinge which connects the ladder to the ceiling frame in a manner which eliminates air from passing between the hinge and the ceiling frame.

10 Claims, 6 Drawing Sheets

CEILING LADDER

FIELD OF THE INVENTION

The present invention is related to ladders. More specifically, the present invention is related to foldable ladders for attics.

BACKGROUND OF THE INVENTION

Ladders such as attic ladders are commonly used to provide convenient access to attics of houses or other structures without the loss of floor space occupied by a permanent stairwell. Typically attic ladders are foldable into an inoperative position within a frame contained in the ceiling. In order to minimize the size of this port and the attic space required, the ladder is usually broken into sections which are folded upon one another within the frame and are extended in alignment with each other when the ladder is unfolded for use.

Attic ladders of this type use various types of counterbalancing means to hold the stairs in their inoperative position. Springs are the most common counterbalance means. These springs are attached to a lever arm which has its greatest leverage in the inoperative position. Once the stairway is unfolded, the effective length of lever arm approaches zero as the mechanism rotates.

Previous designs for this mechanism do not allow the lever arm of the spring to become zero and therefore tend to lift the ladder slightly while unfolded. This causes the ladder to feel springy as it is climbed. Also due to different ceiling heights, each ladder must be trimmed to fit a particular installation. Because the ladder does not firmly lock into place, the trimming procedure is very difficult to do correctly.

A further problem with counterbalance mechanisms result from their connection to the ladder. The linkages that connect the counterbalance mechanism to the ladder are stressed when the ladder is loaded. Typically, these linkages are manufactured as inexpensively as possible; though operative, they result in a flimsy feeling ladder.

Attic ladders are connected to the framed opening with a hinge. Typically, one leg of the hinge is attached to the upper section of the ladder and the other leg is attached to the inside surface of the framed opening. This arrangement results in an ineffective energy seal.

A further problem with attic ladders results from the connection between the ladder sections. Typical connections allow the load to be carried by the ends of each rail section. Because of the nature of wood, this causes damage and deformation, which in turn results in increased play in the hinge connection.

An important object of the invention is to provide a hinge which protects the wooden sections of the ladder rails from undue stress.

A further object of the invention is to provide a counterbalance mechanism that offers a firmer and more solid feel.

A further object of the invention is to provide a construction that allows the counterbalance mechanism to remain firmly in an inoperative position while the ladder is unfolded.

A further object of the invention is to provide a hinge construction that improves the energy seal between the frame and the attic ladder door, when the door is closed.

SUMMARY OF THE INVENTION

The present invention pertains to a hinge for connecting two sections of a foldable ladder having a first section and a second section. The hinge is comprised of a first portion attached to the first section. The first portion has a first load bearing surface. The hinge is also comprised of a second portion having a second load bearing surface. The second portion is attached to the second section and is rotatably connected to the first portion such that when the first and second sections are aligned to form the ladder, the first load bearing surface contacts the second load bearing surface.

In a preferred embodiment, each portion is attached to its respective section with at least three rivets, is rectangular, made of metal, and is attached to its respective section such that it does not extend beyond the width of the section.

The present invention pertains to a counterbalance assembly for a foldable ladder in a ceiling frame. The counterbalance assembly is comprised of a spring connected to the ceiling frame. The assembly is also comprised of a first arm having an offset, a second arm rotatably connected to the first arm, and a third arm rotatably connected to the second arm and to the ladder. The assembly is also comprised of a pivot plate fixedly connected to the ceiling frame and rotatably connected to the second arm such that when the ladder is fully extended, the offset of the first arm allows the rotatable connection of the first and second arms to be in alignment with the axis of the spring.

In a preferred embodiment, the third arm and second arm each have a rib which provides for added rigidity of the assembly The present invention pertains to a continuous hinge for a foldable attic ladder and a ceiling frame. The continuous hinge is comprised of a first leg connected to the ladder. Additionally, the continuous hinge is comprised of a second leg rotatably connected to the first leg and the external surface of the ceiling frame such that air is essentially eliminated from passing between the hinge and the ceiling frame.

The present invention is comprised of a foldable ladder having a plurality of sections which align during use to form a continuous ladder which are foldable upon themselves for storage in a ceiling frame. The foldable ladder is comprised of hinges for connecting the sections. Each hinge has a first and second load bearing surface which contact each other when the ladder is extended. The ladder is also comprised of a counterbalance assembly, and a continuous hinge which connects the ladder to the ceiling frame and which essentially eliminates air from passing between the hinge and the ceiling frame.

BRIEF DESCRIPTION OF THE DRAWINGS

In the accompanying drawings, the preferred embodiments of the invention and preferred methods of practicing the invention are illustrated in which.

DESCRIPTION OF THE PREFERRED EMBODIMENT

Figure 1:
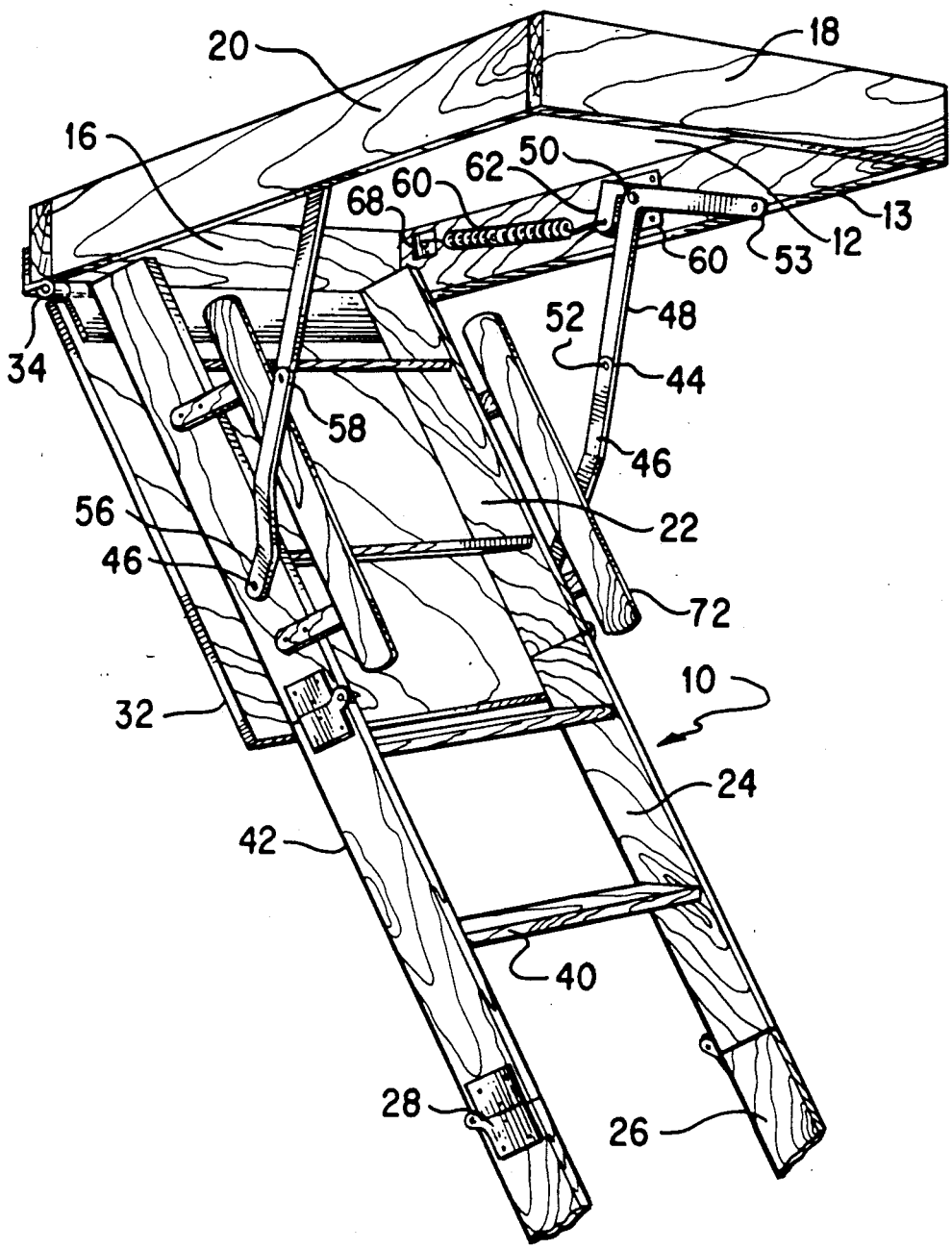
FIG. 1 is a perspective view of the ladder showing the parts unfolded for operation.
Figure 2:
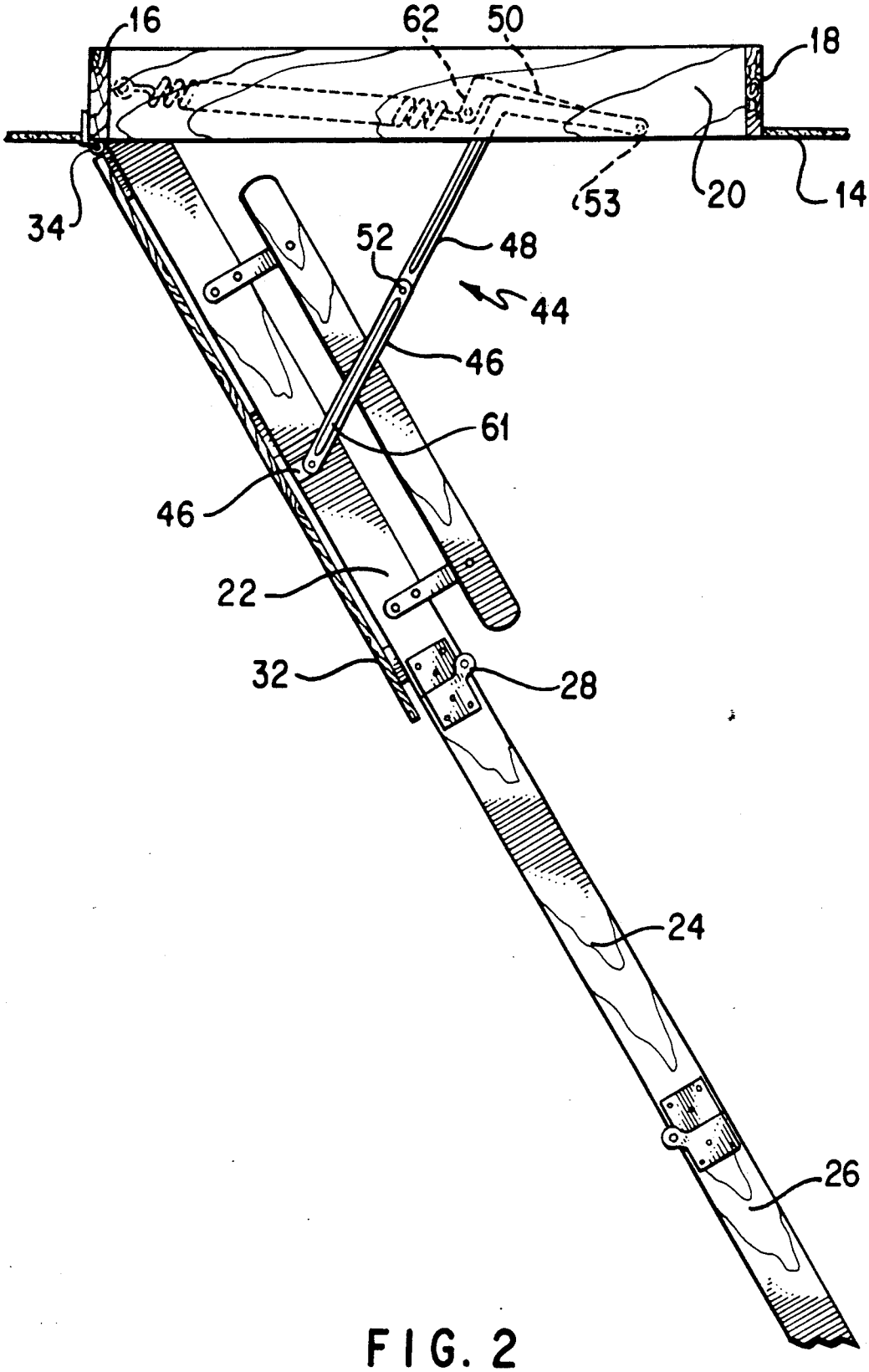
FIG. 2 is a central vertical longitudinal section view of the attic ladder showing the parts unfolded for operation.
Figure 4:
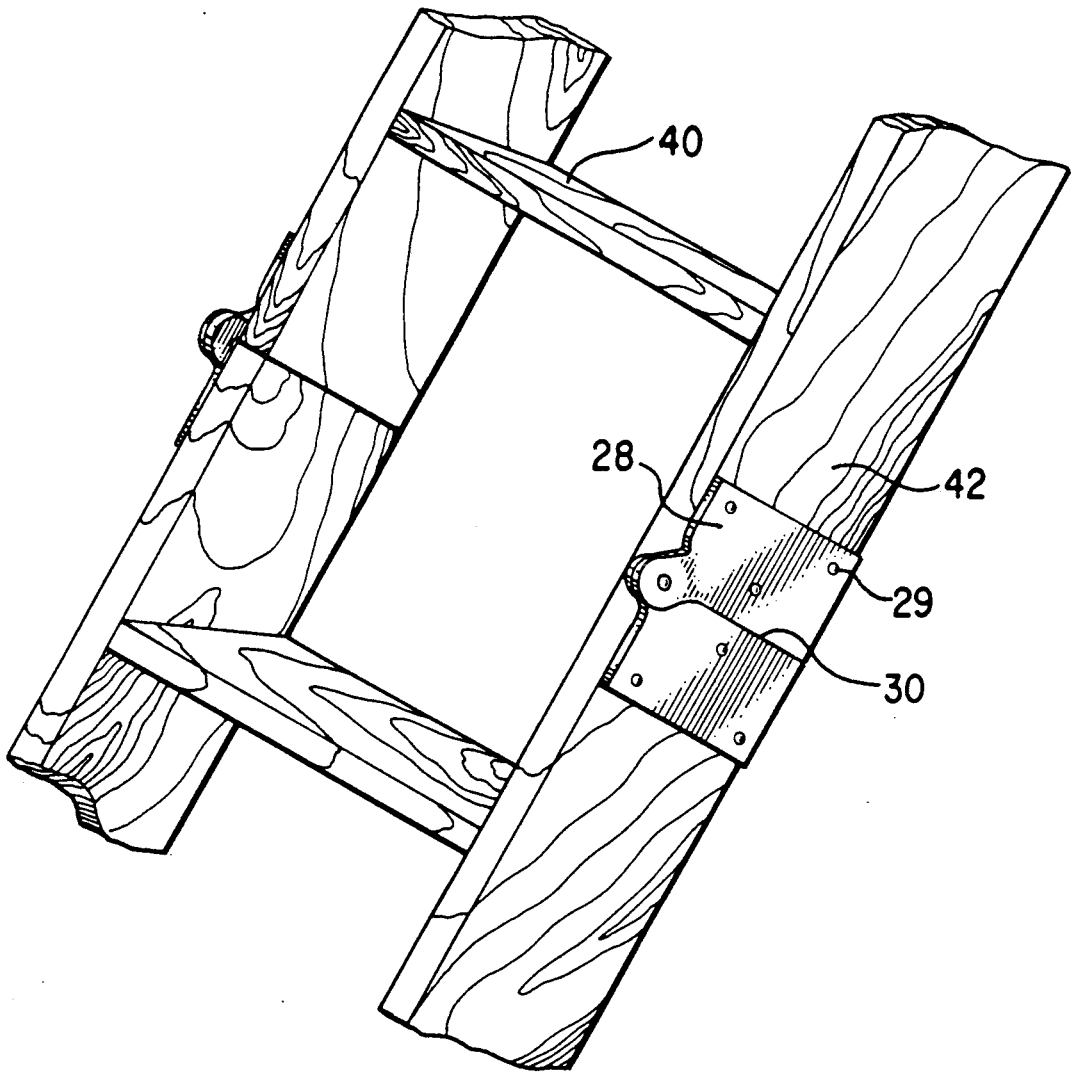
FIG. 4 is a detailed perspective of the hinge which connects the sections of the attic ladder together.

Referring now to the drawings wherein like reference numerals refer to similar or identical parts throughout the several views and more specifically to FIGS. 1 and 2 thereof, there is shown a ladder 10 which is adapted to be mounted in an opening 12 formed in the ceiling 14, which has a surrounding frame 15. This frame is typically rectangular and includes transverse ends 16 and 18 and side members 20. The ladder 10 is comprised of a plurality of sections 22, 24 and 26, which are connected by hinges 28. These hinges are preferably attached to each section with three rivets 29 and are designed in a manner which allows their sides 30 to bear on each other when the ladder 10 is unfolded as shown in FIG. 4.

Figure 3:
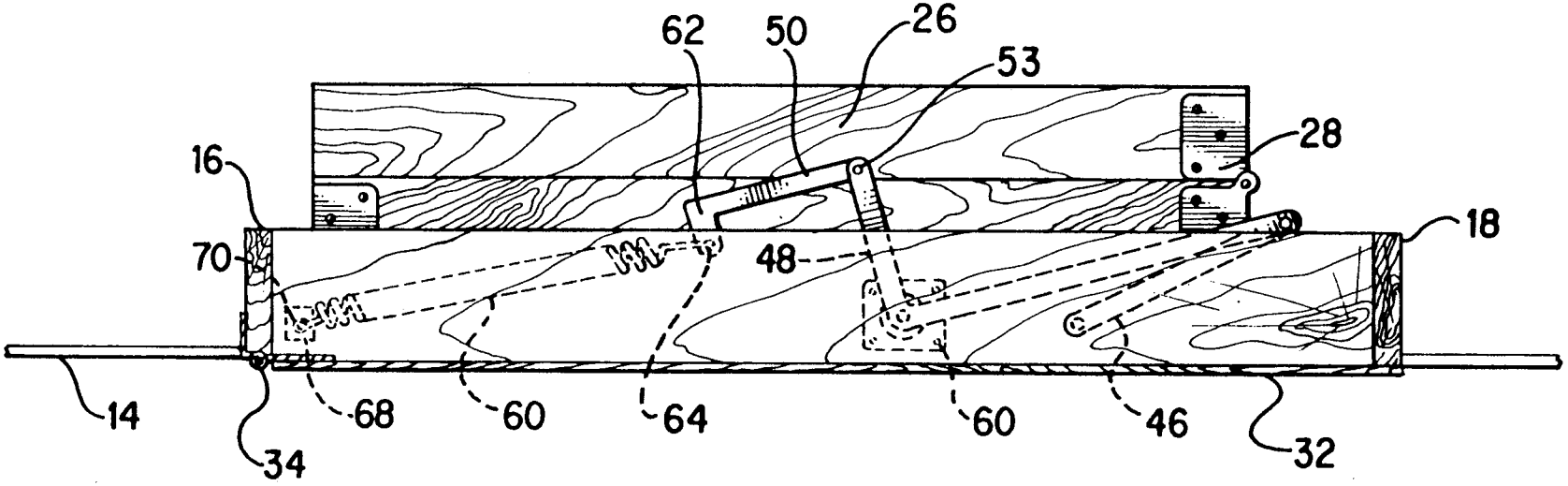
FIG. 3 is a similar sectional view showing the attic ladder folded.

A cover for the bottom of the frame 14 is indicated by numeral 32. This cover 32 fits into the bottom of the frame when the parts of the ladder 10 are folded as shown in FIG. 3. The upper ladder section 22 is mounted to the cover in a suitable manner.

Figure 5:
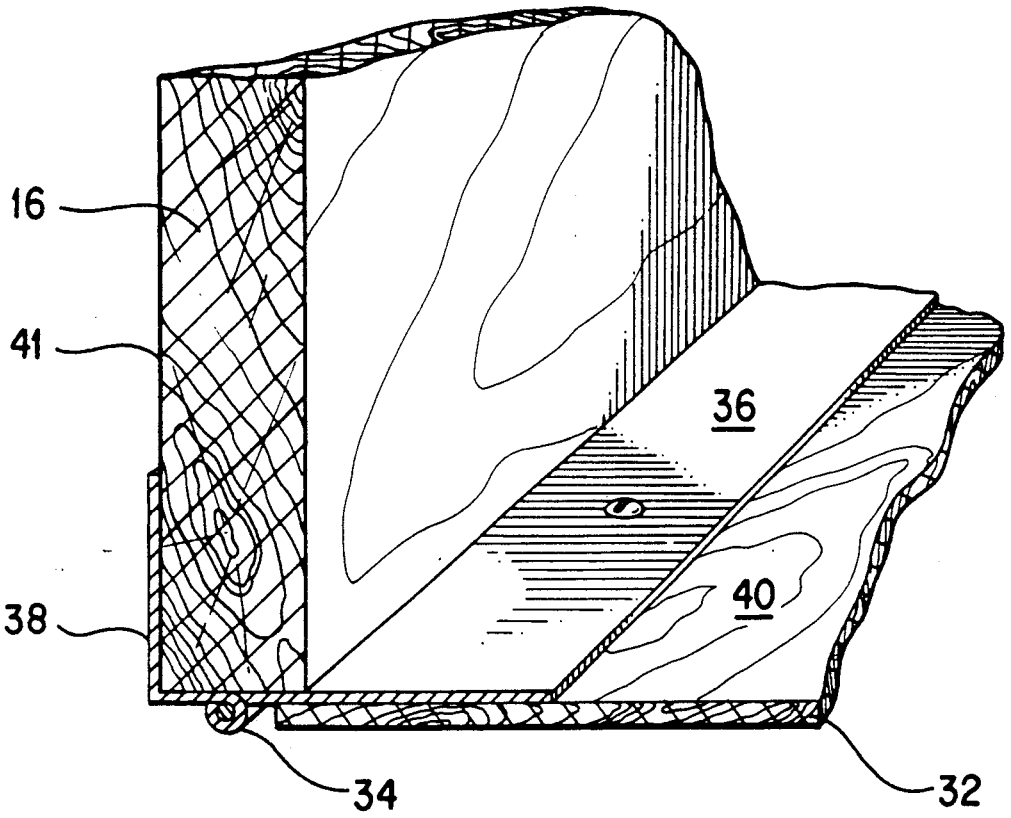
FIG. 5 is a detailed perspective of the continuous hinge that connects the ladder to the ceiling frame.

The cover 32 is preferably connected to the transverse end of the ceiling frame 16 by a continuous hinge 34 as shown in FIG. 5. The hinge 34 is comprised of two legs 36 and 38. Leg 36 is attached to the upper surface 40 of cover 32 in a suitable manner. Leg 38 is bent at a right angle and is attached to the outer surface 41 of the frame's transverse end 16.

The ladder sections are provided with the usual steps 40 between the siderunners 42 of each section. Each siderunner of the upper ladder, section 22 is preferably pivotably connected to a counterbalance assembly 44. Each counterbalance assembly is preferably comprised of three arms 46, 48 and 50 which are connected by rivets 52 and 53 in a manner that will allow the attic ladder to be withdrawn to a folded position substantially flush with the lower edge of the frame as shown in FIG. 3.

Figure 6:
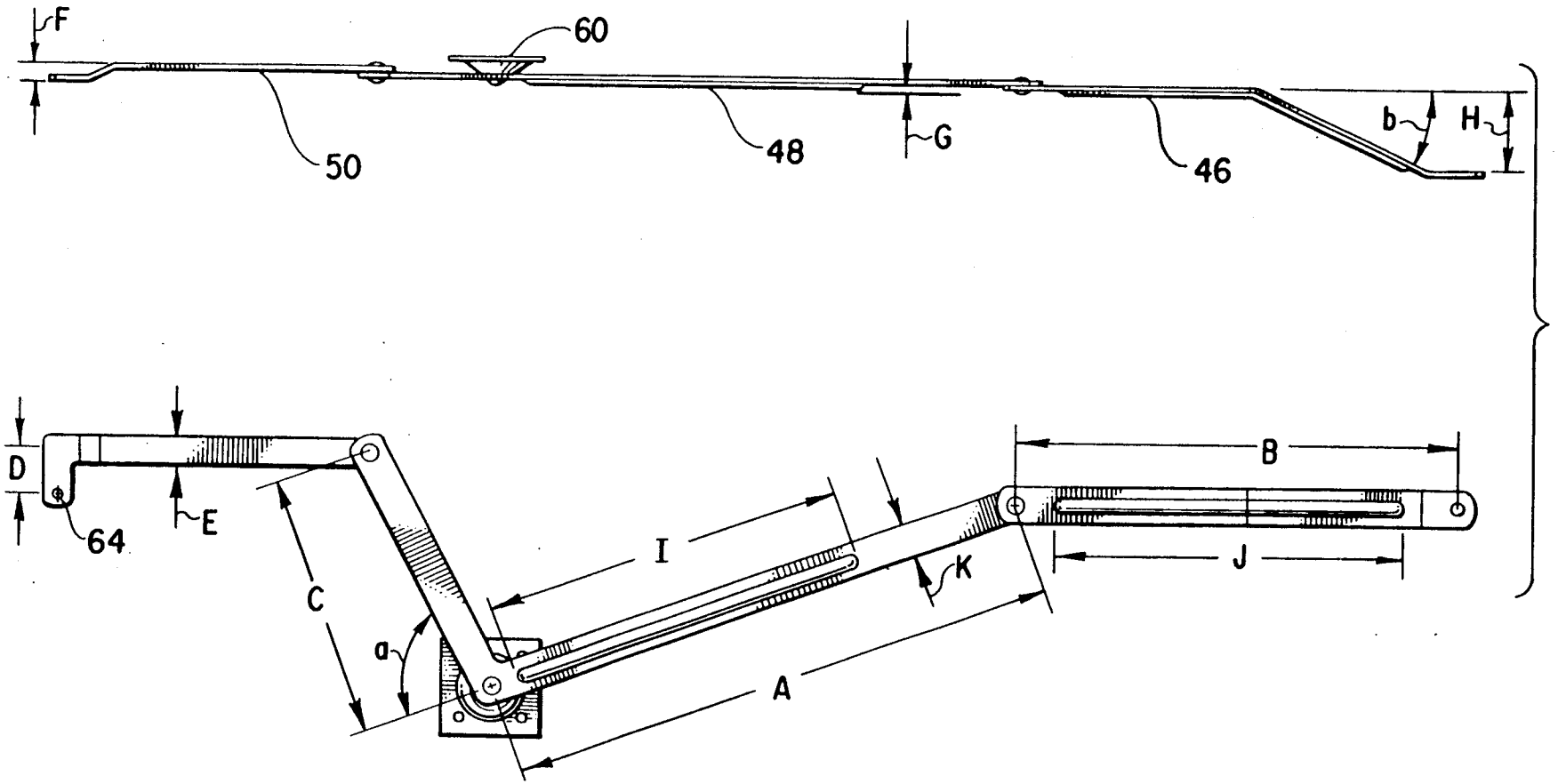
FIG. 6 is a schematic representation of the arms of the counterbalance assembly.

Arm 46 is bent in a manner that allows connection to arm 48 which are of different widths as shown in FIG. 1. Arm 48 is preferably stamped from a single piece of metal and is connected to side members 20 by a pivot plate 60. Stamped ribs 61 are provided in arm 46 as well as arm 48, for added rigidity. Arm 50 has an offset 62, which contains an eye 64 through which one end of a spring 66 is attached. The opposite end of spring 66 is attached to the frame side members by means of a mounting plate 68, which has an eye 70. The following table describes the dimensions of arms 46, 48 and 50 of the counterbalance assembly 44, which is shown in FIG. 6.

| | |
|---|---|
| A | 16.00 in. |
| B | 12.50 in. |
| C | 7.44 in. |
| D | 1.25 in. |
| E | .75 in. |
| F | .28 in. |
| G | .13 in. |
| H | 2.28 in. |
| I | 10 in. |
| J | 10 in. |
| K | 1 in. |
| a | 83° |
| b | 25° |

To facilitate ascending the stairway handrails 72 can be attached to the siderunners 42 of the upper section 22 in an appropriate manner.

The parts of the ladder normally occupy the positions shown in FIG. 3. Spring 66 exerts a pull on arm 50 of the counterbalance assembly 44, thereby creating a counterclockwise moment which is transferred through arms 46 and 48 to the upper ladder section 22. The moment holds the ladder in the folded position. Leg 36 of continuous hinge 34 contacts the bottom of frame end 16 in an uninterrupted manner, thereby resulting in an energy efficient seal.

When the ladder is to be used, the cover is pulled downwardly until the ladder sections can be unfolded in alignment with each other. Once the ladder assumes a position shown in FIGS. 1 and 2, the surfaces 30 of hinge 28 bear against one another. During loading of the ladder, these surfaces will bear the load which is typically felt by the ends of the wooden siderunners 42.

As the ladder is unfolded, the spring 66 pulls on arm 50 of the counterbalance assembly. As best seen in FIG. 3, a line can be imagined that intersects bracket 70 and the center of the pivot plate 60. The perpendicular distance between this line and rivet 53 defines the lever arm for the force of the spring. This creates a counterclockwise moment which resists the clockwise moment created by the weight of the ladder. The lever arm becomes shorter as the arm 48 rotates clockwise until it finally become zero just before the operational position of the ladder. At this point, rivet 53, bracket 68 and the center of pivot plate 60 are in alignment with each other. The offset 62 of arm 50 allows further rotation of the counterbalance assembly to its operational position, whereby rivet 53 falls below the line which intersects bracket 70 and pivot plate 60, resulting in a clockwise moment that forces the ladder onto the floor.

When the ladder is climbed, stamped ribs 61 increase the rigidity of counterbalance arms 46 and 48, thereby minimizing deflection.

After operation, the ladder is readily folded by swinging the sections 24 and 26 upwardly over section 22 and then pushing upwardly on the free end of the cover 32. As the counterbalance assembly is rotated from the operative position, a counterclockwise moment is created by spring 66 which pulls the ladder closed.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A counterbalance assembly for a foldable ladder in a ceiling frame comprising:

a spring connected to the ceiling frame;

a linkage comprised of a first arm having an offset to which the spring is attached, a second arm rotatably connected to the first arm, and a third arm rotatably connected to the second arm and to the ladder; and a pivot plate fixedly connected to the ceiling frame and rotatably connected to the second arm such that when the ladder is fully extended, the offset of the first arm allows the rotatable connection of the first and second arms to be in alignment with the axis of the spring.

2. An assembly as described in claim 1 wherein the third arm and second arm each have a rib which provides for added rigidity of the assembly.

3. A counterbalance assembly as described in claim 2 wherein the spring is connected to the ceiling frame with a mounting plate.

4. A continuous hinge for a foldable ladder in a ceiling frame comprising:

a first leg connected to the ladder; and a second leg rotatably connected to the first leg and the external surface of the ceiling frame such that air is essentially eliminated from passing between the hinge and the ceiling frame.

5. A continuous hinge as described in claim 4 wherein the second leg is bent in a right angle for allowing it to be connected to an external vertical face of the ceiling frame.

6. A foldable ladder having a plurality of sections which align during use to form a continuous ladder and which are foldable upon themselves for storage in a ceiling frame comprising:

hinges for connecting the sections, each hinge having a first and second load bearing surface which contacts each other when the ladder is extended;

a counter balance assembly which connects the ladder to the ceiling frame; and a continuous hinge which connects the ladder to the ceiling frame and which essentially eliminates air from passing between the hinge and the ceiling frame.

7. A ladder as described in claim 6 wherein the counter-balance assembly includes a spring connected to the ceiling frame;

a linkage comprised of a first arm having an offset, a second arm rotatably connected to the first arm, and a third arm rotatably connected to the second arm and to the ladder; and a pivot plate fixedly connected to the ceiling frame and rotatably connected to the second arm such that when the ladder is fully extended, the offset of the first arm allows the rotatable connection of the first and second arms to be in alignment with the axis of the spring.

8. A ladder as described in claim 7 wherein the third arm and second arm each have a rib which provides for added rigidity of the counterbalance assembly.

9. A ladder as described in claim 8 wherein the arms are comprised of stamped metal.

10. A ladder as described in claim 9 wherein the first arm has an eye through which an end of the spring is attached.

* * * * *

UNITED STATES PATENT AND TRADEMARK OFFICE

CERTIFICATE OF CORRECTION

PATENT NO. : 5,050,706

DATED : September 24, 1991

INVENTOR(S) : Paul E. Cole, et al

It is certified that error appears in the above-identified patent and that said Letters Patent is hereby corrected as shown below:

Figure 1, the reference numeral "60" referring to the spring should be replaced with reference numeral -- 66 -- .

Figure 3, the reference numeral "60" referring to the spring should be replaced with reference numeral -- 66 -- .

Figure 5, the reference numeral "40" referring to the upper surface of cover 32 should be replaced with reference numeral -- 33 -- .

Column 3, line 13, replace "15" with -- 13 -- .

Column 3, line 31, replace "40" with -- 33 -- .

Column 4, line 26, replace "bracket" with -- eye -- .

Column 4, line 34, replace "bracket 68" with -- eye 70 -- .

Column 4, line 39, replace "bracket" with -- eye -- .

In the abstract, line 7, replace "support" with -- supporting --

Signed and Sealed this

Twenty-seventh Day of April, 1993

*Attest:*

MICHAEL K. KIRK

*Attesting Officer*

*Acting Commissioner of Patents and Trademarks*